US009744097B2

(12) United States Patent
DeVlleger et al.

(10) Patent No.: US 9,744,097 B2
(45) Date of Patent: Aug. 29, 2017

(54) WEARABLE THORAX PERCUSSION DEVICE

(75) Inventors: Marten Jan DeVlleger, Taber (CA); Mark Sasha Drlik, Victoria (CA)

(73) Assignee: Hill-Rom Services Pte. Ltd., Batesville, IN (US)

( * ) Notice: Subject to any disclaimer, the term of this patent is extended or adjusted under 35 U.S.C. 154(b) by 741 days.

(21) Appl. No.: 13/538,716

(22) Filed: Jun. 29, 2012

(65) Prior Publication Data

US 2014/0005579 A1 Jan. 2, 2014

(51) Int. Cl.
*A61H 23/00* (2006.01)
*A61H 23/02* (2006.01)

(52) U.S. Cl.
CPC .. *A61H 23/0218* (2013.01); *A61H 2201/0111* (2013.01); *A61H 2201/1619* (2013.01); *A61H 2205/084* (2013.01)

(58) Field of Classification Search
CPC ..... A61H 23/00; A61H 23/0218; A61H 2201/1619; A61H 2201/084; A61H 2031/001; A61H 2031/002
See application file for complete search history.

(56) References Cited

U.S. PATENT DOCUMENTS

| | | | |
|---|---|---|---|
| 1,646,590 | A | 10/1927 | Mildenberg |
| 2,486,667 | A | 11/1949 | Meister |
| 3,053,250 | A | 9/1962 | Stubbs |
| 3,291,123 | A | 12/1966 | Terauchi |
| 3,310,050 | A | 3/1967 | Goldfarb |
| 3,460,531 | A | 8/1969 | Gardner |
| 3,802,417 | A | 4/1974 | Lang |
| 3,955,563 | A | 5/1976 | Maione |
| 4,069,816 | A | 1/1978 | Yamamura et al. |
| 4,079,733 | A | 3/1978 | Denton et al. |
| 4,098,266 | A | 7/1978 | Muchisky et al. |
| 4,102,334 | A | 7/1978 | Muchisky |
| 4,216,766 | A | 8/1980 | Duykers et al. |

(Continued)

FOREIGN PATENT DOCUMENTS

| | | |
|---|---|---|
| CA | 2563723 | 8/2011 |
| GB | 1136896 | 12/1968 |

(Continued)

OTHER PUBLICATIONS

Rubin, Bruce K.; Emerging Therapies for Cystic Fibrosis Lung Disease; Chest; 1999; vol. 115; pp. 1120-1126.

(Continued)

*Primary Examiner* — Justine Yu
*Assistant Examiner* — Timothy Stanis
(74) *Attorney, Agent, or Firm* — Barnes & Thornburg LLP

(57) ABSTRACT

A wearable thorax percussion device for dislodging mucous buildup in the airways of a human patient, the device comprising a garment fitting over the thorax, a rigid element attached to the external surface of the garment, an electromechanical actuator retained by the rigid element to intermittently percuss the thorax, and an electronic controller for generating and modulating an electrical signal to energize the actuator. The rigid element may be adjustably positioned on the garment to accommodate thoraxes of different dimensions. The actuator may be compressible between the rigid element and the thorax to better maintain contact with the thorax.

10 Claims, 7 Drawing Sheets

(56) References Cited

U.S. PATENT DOCUMENTS

| | | | | |
|---|---|---|---|---|
| 4,387,708 | A | 6/1983 | Davis | |
| 4,397,306 | A | 8/1983 | Weisfeldt et al. | |
| 4,453,538 | A | 6/1984 | Whitney | |
| 4,508,107 | A | 4/1985 | Strom et al. | |
| 4,512,339 | A | 4/1985 | McShirley | |
| 4,530,349 | A | 7/1985 | Metzger | |
| 4,624,244 | A | 11/1986 | Taheri | |
| 4,697,580 | A | 10/1987 | Terauchi | |
| 4,838,263 | A | 6/1989 | Warwick et al. | |
| 4,887,594 | A | 12/1989 | Siegel | |
| 4,977,889 | A | 12/1990 | Budd | |
| 5,018,517 | A | 5/1991 | Liardet | |
| 5,056,505 | A | 10/1991 | Warwick et al. | |
| 5,167,226 | A | 12/1992 | Laroche et al. | |
| 5,181,504 | A | 1/1993 | Ono et al. | |
| 5,235,967 | A | 8/1993 | Arbisi et al. | |
| 5,261,394 | A | 11/1993 | Mulligan et al. | |
| 5,334,131 | A | 8/1994 | Omandam et al. | |
| 5,451,190 | A | 9/1995 | Liardet | |
| 5,453,081 | A | 9/1995 | Hansen | |
| 5,455,159 | A | 10/1995 | Mulshine et al. | |
| 5,496,262 | A | 3/1996 | Johnson, Jr. et al. | |
| 5,569,170 | A | 10/1996 | Hansen | |
| 5,716,131 | A | 2/1998 | Breeding | |
| 5,738,637 | A | 4/1998 | Kelly et al. | |
| 5,769,797 | A | 6/1998 | Van Brunt et al. | |
| 5,769,800 | A | 6/1998 | Gelfand et al. | |
| 5,891,062 | A | 4/1999 | Schock et al. | |
| 6,022,328 | A | 2/2000 | Hailey | |
| 6,036,662 | A | 3/2000 | Van Brunt et al. | |
| 6,098,222 | A | 8/2000 | Hand et al. | |
| 6,174,295 | B1 | 1/2001 | Cantrell et al. | |
| 6,176,235 | B1 | 1/2001 | Benarrouch et al. | |
| 6,190,337 | B1 | 2/2001 | Nedwell | |
| 6,193,677 | B1 | 2/2001 | Cady | |
| 6,193,678 | B1 | 2/2001 | Brannon | |
| 6,254,556 | B1 | 7/2001 | Hansen et al. | |
| 6,290,660 | B1 | 9/2001 | Epps et al. | |
| 6,352,518 | B1 | 3/2002 | nee Wolf | |
| D456,591 | S | 5/2002 | Hansen | |
| D461,897 | S | 8/2002 | Hansen et al. | |
| 6,478,755 | B2 | 11/2002 | Young | |
| D469,876 | S | 2/2003 | Hansen et al. | |
| 6,547,749 | B2 | 4/2003 | Hansen | |
| D478,989 | S | 8/2003 | Hansen et al. | |
| 6,676,614 | B1 | 1/2004 | Hansen et al. | |
| 6,702,769 | B1 | 3/2004 | Fowler-Hawkins | |
| 6,736,785 | B1 | 5/2004 | Van Brunt | |
| 6,958,047 | B2 | 10/2005 | DeVlieger | |
| 6,984,214 | B2 | 1/2006 | Fowler-Hawkins | |
| 7,074,200 | B1 | 7/2006 | Lewis | |
| 7,128,811 | B2 | 10/2006 | Watanabe | |
| D531,728 | S | 11/2006 | Helgeson | |
| 7,207,953 | B1 | 4/2007 | Goicaj | |
| 7,232,417 | B2 | 6/2007 | Plante | |
| D547,718 | S | 7/2007 | Helgeson et al. | |
| 7,278,978 | B1 | 10/2007 | Hansen et al. | |
| 7,343,916 | B2 | 3/2008 | Biondo et al. | |
| 7,374,550 | B2 | 5/2008 | Hansen et al. | |
| 7,416,536 | B2 | 8/2008 | DeVlieger | |
| 7,445,607 | B2 | 11/2008 | Plante | |
| D585,991 | S | 2/2009 | Helgeson et al. | |
| 7,537,575 | B2 | 5/2009 | Hansen et al. | |
| 7,597,670 | B2 | 10/2009 | Warwick et al. | |
| 7,618,384 | B2 | 11/2009 | Nardi et al. | |
| 7,713,219 | B2 | 5/2010 | Helgeson et al. | |
| 7,736,324 | B1 | 6/2010 | Helgeson | |
| 7,762,967 | B2 | 7/2010 | Warwick et al. | |
| 7,785,280 | B2 | 8/2010 | Kivisto | |
| 7,798,982 | B2 * | 9/2010 | Zets | A61H 23/0218 601/46 |
| 7,927,293 | B1 | 4/2011 | Ignagni et al. | |
| 7,931,607 | B2 | 4/2011 | Biondo et al. | |
| D639,954 | S | 6/2011 | Helgeson et al. | |
| 7,981,066 | B2 | 7/2011 | Lewis | |
| 8,108,957 | B2 | 2/2012 | Richards et al. | |
| 8,192,381 | B2 | 6/2012 | Nozzarella | |
| 8,197,428 | B2 | 6/2012 | Helgeson et al. | |
| 8,202,237 | B2 | 6/2012 | Helgeson et al. | |
| 8,241,233 | B2 | 8/2012 | Litton et al. | |
| 8,257,288 | B2 | 9/2012 | Hansen et al. | |
| 8,273,039 | B1 | 9/2012 | Ignagni | |
| 8,460,223 | B2 | 6/2013 | Huster et al. | |
| 8,584,279 | B2 | 11/2013 | Richards et al. | |
| D697,197 | S | 1/2014 | Hansen et al. | |
| 8,734,370 | B1 | 5/2014 | Ignagni | |
| 8,777,880 | B2 | 7/2014 | Davis et al. | |
| 8,790,285 | B2 | 7/2014 | Bisera et al. | |
| 8,801,643 | B2 | 8/2014 | Deshpande et al. | |
| 2002/0014235 | A1 | 2/2002 | Rogers et al. | |
| 2002/0016560 | A1 | 2/2002 | Hansen | |
| 2002/0111571 | A1 | 8/2002 | Warwick et al. | |
| 2002/0195144 | A1 | 12/2002 | Hand et al. | |
| 2004/0069304 | A1 | 4/2004 | Jam | |
| 2004/0097842 | A1 | 5/2004 | Van Brunt et al. | |
| 2004/0097843 | A1 | 5/2004 | Van Brunt et al. | |
| 2004/0097844 | A1 | 5/2004 | Van Brunt et al. | |
| 2004/0097845 | A1 | 5/2004 | Van Brunt | |
| 2004/0097846 | A1 | 5/2004 | Van Brunt et al. | |
| 2004/0097847 | A1 | 5/2004 | Van Brunt et al. | |
| 2004/0097849 | A1 | 5/2004 | Van Brunt | |
| 2004/0097850 | A1 | 5/2004 | Plante | |
| 2004/0158177 | A1 | 8/2004 | Van Brunt et al. | |
| 2005/0234372 | A1 | 10/2005 | Hansen et al. | |
| 2006/0015045 | A1 * | 1/2006 | Zets et al. | 601/78 |
| 2006/0089575 | A1 | 4/2006 | DeVlieger | |
| 2007/0239087 | A1 * | 10/2007 | Kivisto | 601/44 |
| 2008/0108914 | A1 | 5/2008 | Brouqueyre et al. | |
| 2008/0300515 | A1 | 12/2008 | Nozzarella et al. | |
| 2009/0069728 | A1 * | 3/2009 | Hoffmann et al. | 601/46 |
| 2009/0221944 | A1 * | 9/2009 | Hobson | A61H 7/004 601/135 |
| 2009/0255022 | A1 * | 10/2009 | Smith et al. | 2/2.5 |
| 2010/0113993 | A1 * | 5/2010 | Davis et al. | 601/108 |
| 2010/0242955 | A1 | 9/2010 | Hansen | |
| 2010/0249634 | A1 | 9/2010 | Hansen | |
| 2011/0125068 | A1 | 5/2011 | Hansen et al. | |
| 2011/0166486 | A1 * | 7/2011 | Kumanomido | 601/15 |
| 2012/0259255 | A1 * | 10/2012 | Tomlinson et al. | 601/46 |
| 2012/0291798 | A1 * | 11/2012 | Park et al. | 132/293 |
| 2013/0261518 | A1 | 10/2013 | Hansen et al. | |
| 2013/0331747 | A1 | 12/2013 | Helgeson et al. | |

FOREIGN PATENT DOCUMENTS

| | | |
|---|---|---|
| GB | 2 068 737 A | 2/1981 |
| WO | 2011/094883 | 8/2011 |

OTHER PUBLICATIONS

International Biophysics Corporation—"AffloVest Answering Needs: The Role of the AffloVest in the Respiratory Market" AffloVest White Paper.

The "VibraVest" by OxyCare GmbH, VibraVest_engl_web.pdf, Nov. 23, 2011 (3 pages).

* cited by examiner

WEARABLE THORAX PERCUSSION DEVICE

FIELD OF THE INVENTION

The present invention relates to a wearable thorax percussion device.

BACKGROUND OF THE INVENTION

Cystic fibrosis (CF) is a hereditary chronic disease affecting human patients that causes the buildup of thick, sticky mucous in the lungs and other parts of the body. If left untreated, the mucous can clog air ways, and lead to complications such as tissue inflammation or infection, or other symptoms such as coughing, phlegm, and compromised cardio-respiratory performance.

One technique to manage CF is chest physiotherapy (CPT) which involves the manipulation of the patient's thorax to dislodge mucous buildup in the airways and encourage expectoration of the mucous. CPT may have to be performed in several sessions in a day, with each session lasting from between 10 to 45 minutes. CPT can be performed manually by therapists who use their hands to repeatedly percuss (clap, thump or press against) the patient's thorax. However, manually performed CPT can be physically and time demanding and should be performed by a properly trained therapist. Alternatively, CPT can be performed using handheld or wearable mechanical devices. Wearable devices have the advantage over handheld devices of relieving the therapist or patient from having to manipulate the device during the treatment session.

Some wearable devices administer pulsating pneumatic pressure to the patient. U.S. Pat. No. 4,838,263 to Warwick et al, describes a vest bladder containing an air chamber and a pressurizing means to alternately pressurize and depressurize the air chamber to produce a pulsating compression on the patient's thorax. U.S. Pat. No. 6,036,662 to Van Brunt et al. describes a vest containing an air bladder that coverts pulses of air into compressions to the patient's thorax. US Pat. Application No. 2005/0234372 to Hansen et al. describes a vest with an internal air chamber for receiving repeated pulses of air, which translate through the vest as pressure pulses against the patient's thorax. However, these devices rely on intimate contact between the vest and the patient's thorax and tend act over a relatively large area of the patient's thorax, with the result that they may constrict the patient's normal breathing motions.

Some wearable devices sonically transmit pressure waves to the patient generated by an acoustic transducer. U.S. Pat. No. 6,193,677 to Cady describes a vest incorporating a speaker to deliver low frequency pulsed audio signals to the patient. U.S. Pat. No. 6,193,677 to Plante describes a vest with a plurality of pockets or a harness-type arrangement to support an acoustic transducer to propagate acoustic waves via an acoustic coupling chamber to the patient. US Pat. Application No. 2008/0108914 to Brouqueyre et al. describes a vest with a vibration unit to transmit low frequency acoustic waves through a form-fitting material like a gel or fluid contained in the inner surface of the vest. However, transmission of pressure waves through a compressible medium may not be as efficacious as direct mechanical manipulation of the patient's thorax.

Some wearable devices administer mechanical impacts or vibrations to the patient. U.S. Pat. No. 3,310,050 to Goldfarb describes a vest-like garment or harness-type arrangement with a plurality of pockets to support a plurality of electromechanical vibrators to produce pulsating impacts that are communicated to the patient either by direct contact with the patient or indirectly through coupling constituted by the vest material and webbing belts. U.S. Pat. No. 5,235,967 to Arbisi et al. describes a vest-like garment with an internalized frame continuous throughout the garment, containing a plurality of movable electrically conductive elements that are actuated by a pulsed magnetic field produced by drive coils that are energized by a drive circuit. U.S. Pat. No. 5,261,394 to Mulligan et al. describes a percussive aid comprising arms that are reciprocally driven between a cocked position and a contact position by a drive mechanism, within a frame curved to fit the patient and adapted to be worn like a backpack, secured to the patient's thorax by shoulder and waist straps. US Pat. Appl. No. 2006/0089575 to DeVlieger describes a rigid element with pads clamped to the body, which transmit vibrations from an attached vibrator. The effectiveness of such devices depends on the ability to maintain contact at the interface between the device and the patient.

Accordingly, there remains a need for a wearable thorax percussion device that provides for effective, comfortable, convenient and consistent treatment of the patient.

SUMMARY OF THE INVENTION

In one aspect, the present invention provides a wearable thorax percussion device comprising:

(a) a garment fitting over the thorax and having an external surface facing away from the thorax;
(b) at least one rigid element attached to the external surface of the garment;
(c) at least one electromechanical actuator retained by the at least one rigid element and exhibiting a reciprocating motion when energized with electricity for intermittently percussing the thorax, either directly or indirectly;
(d) an electronic controller for generating and modulating an electrical signal to energize the at least one actuator.

In another aspect, the invention may comprise a wearable thorax percussion device comprising at least one electromechanical actuator, which comprises:

(a) a permanent magnet producing a first magnetic field;
(b) an electromagnet energizable to produce a second magnetic field;
(c) a cap in driving engagement with either the permanent magnet or the electromagnet for percussing the thorax;

wherein the first magnetic field and the second magnetic field interact to repel the permanent magnet and the electromagnet and drive the cap against the thorax.

Embodiments of the device provides a mechanical means for CPT without the labour of a trained therapist. The device may be embodied in a form that is light weight, and ergonomically adapted to the anatomy of the thoracic region. The attachment of the rigid elements to the external surface of the garment permits the device to readily be adjusted for thoraxes of different dimensions. In one embodiment, the use of a rigid element to preload compressible actuators assists in maintaining positive contact between the device and the thorax.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION

The invention relates to a wearable thorax percussion device 10. When describing the present invention, all terms not defined herein have their common art-recognized meanings.

The term "thorax" as used herein means the region of the human body including the thoracic cavity enclosing the lungs, trachea and bronchi or portions thereof.

Figure 1:
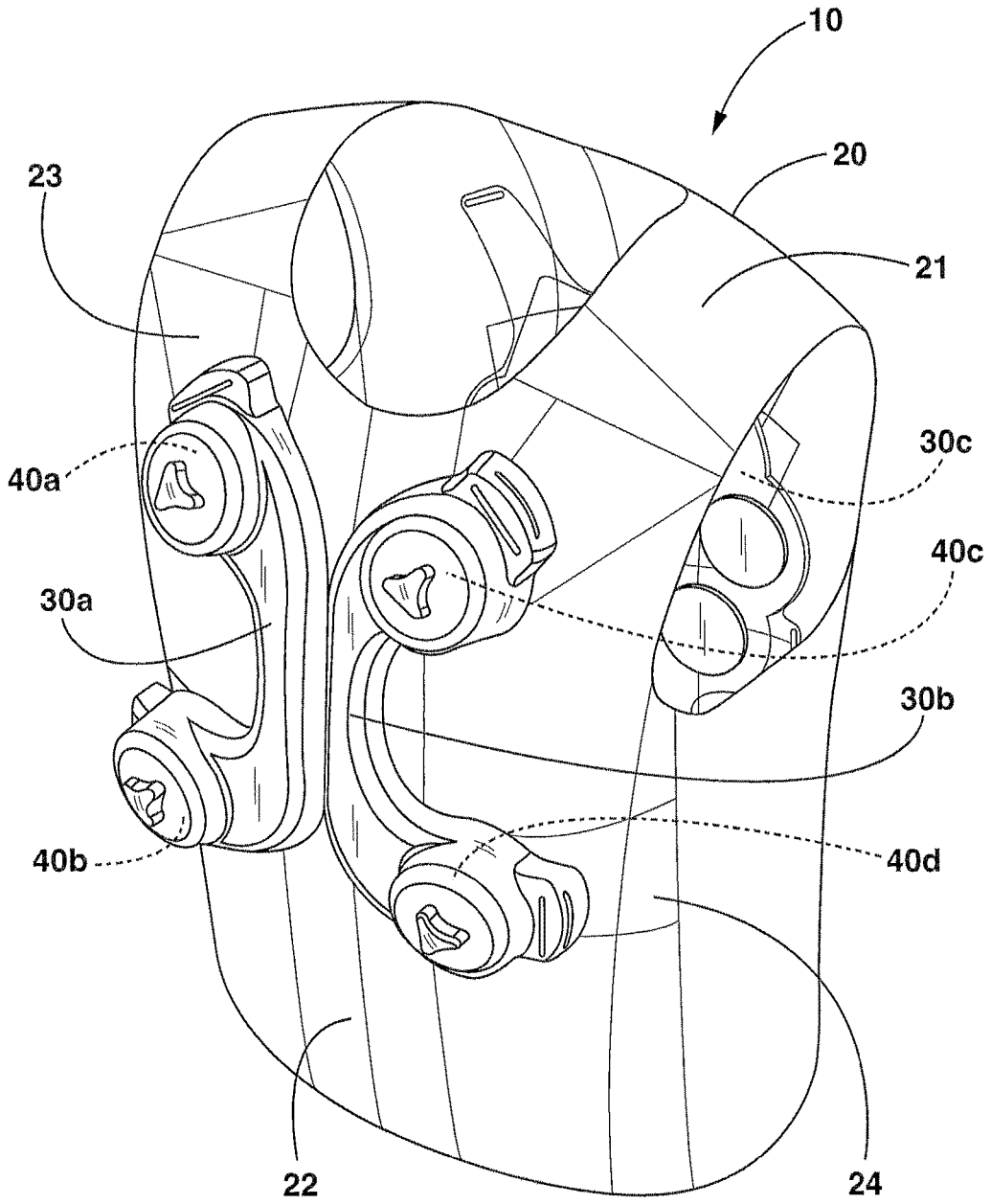
FIG. 1 is a front perspective view of the device of the present invention.
Figure 2:
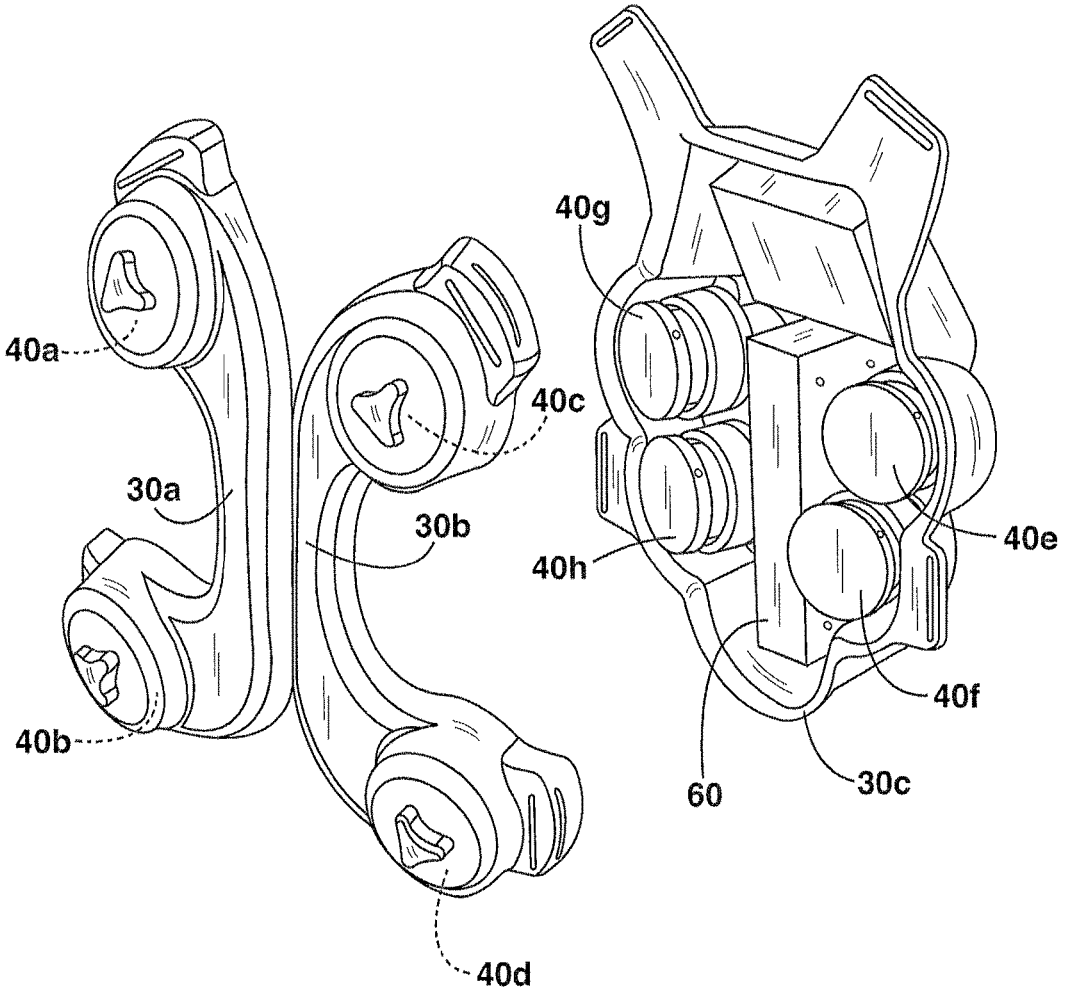
FIG. 2 is a front perspective view of the front rigid elements and a rear perspective view of rear rigid element.
Figure 3:
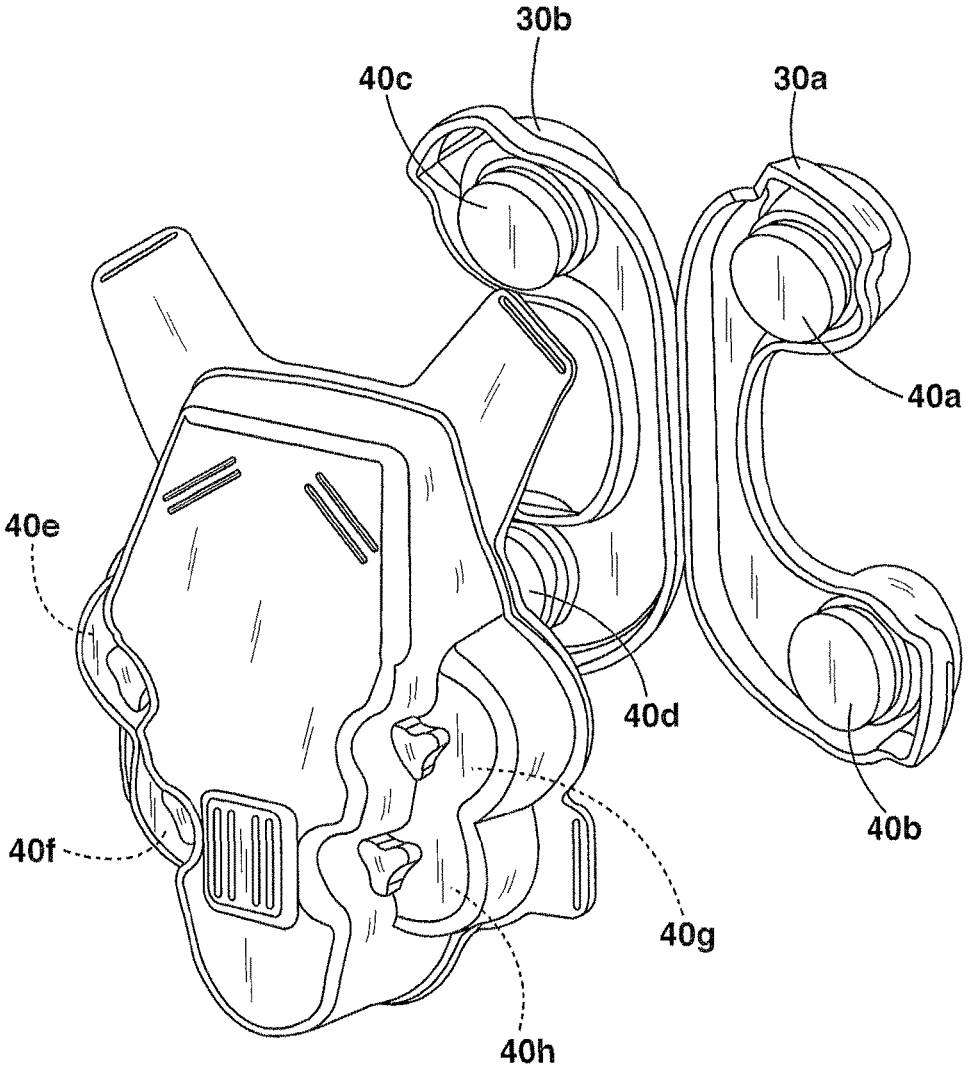
FIG. 3 is front perspective view of the rear rigid element and a rear perspective view of the front rigid elements.

As shown in FIGS. 1 to 3, an embodiment of the present invention comprises a garment (20), a plurality of rigid elements (30*a*-30*c*), a plurality of electromechanical actuators (40*a*-40*h*), and an electronic controller (60). The garment (20) fits over the thorax and has an external surface (21) facing away from the thorax. The rigid elements (30) are attached to the external surface (21) of the garment (20). The electromechanical actuators (40) are retained by one of the rigid elements (30). The actuators exhibit a reciprocating motion when energized to intermittently percuss the thorax, either directly or indirectly. The electronic controller (60) generates and modulates an electrical signal to energize the actuators (40).

In one embodiment, as shown in FIG. 1, the garment (20) is a vest with a variety of fasteners and adjustments to facilitate fitting the garment (20) to the thorax and positioning the frames (30) on the garment (20). The portion (22) of the garment (20) covering the front of the thorax may open and close with a hook and loop fastener, or other conventional fasteners such as zippers, clips or buttons, to permit the patient to don the garment (20). Alternatively, the garment may be made of a slightly elastic material to permit the user to slip the garment on, or to adjust to individual body shapes, or both. In one embodiment, a portion (23) of the garment (20) covering the patient's shoulders may have adjustment straps to position the rigid elements (30) to accommodate patients with different sizes and shapes, or patients with mild to severe kephosis, which is common in CF patients. A lower portion (24) of the garment (20) covering the lower thorax has adjustment straps to secure and integrate the front rigid elements (30*a*, 30*b*) and the rear rigid element (30*b*). These straps also accommodate expansion and contraction of the thorax due to breathing, which is typically in the order of about 2 to 6 inches. In other embodiments not shown, the garment (20) may be a t-shirt, sweatshirt, jacket or harness. The garment (20) is preferably constructed of a light weight and flexible material to accommodate the contours of the thorax. The material should be selected to avoid significantly dampening the percussions of the actuators (40) on the thorax. The garment (20) separates the actuators (40) from the user to protect the thorax from pinch points of moving components or electronic components associated with the actuators (40).

In one embodiment, the device comprises a front right rigid element (30*a*), a front left rigid element (30*b*) and a single rear rigid element (30*b*) attached to the front right portion, front left portion, rear portion, respectively, of the exterior surface (21) of the garment (20). This configuration of rigid elements (30) accommodates a garment having a front central closure, such as a full length zipper. The rigid elements may be substantially rigid or semi-rigid. It is not essential that these elements be completely inflexible, but they do have to have enough strength to allow transmission of the percussive force of the actuators to the patient's body, instead of dissipating outwards. Some flexibility may be desired to allow for differences in individual patient sizes and shapes.

The front rigid elements (30*a*, 30*b*) may have a bow-shape to avoid resting on the patient's breasts, which might prevent the retained actuators (40*a* to 40*d*) from positively contacting the thorax. The rigid elements (30) may be configured with cavities, fingers, apertures and other features to retain or permit access to the actuators (40) and the controller (60). In addition to retaining the actuators (40), the rigid elements (30) protect the actuators (40) from "stalling out" if, for example, the patient were to bear weight on the actuators (40) against a chair back while wearing the device. The rigid elements (30) may be manufactured from materials that are light weight, and have sufficient stiffness, impact resistance and durability to retain the actuators (40) with repeated use. Suitable plastics may be used with techniques such as vacuum forming, machining with computer numerical control (CNC), compression molding, reaction-injection molding, injection molding or a combination of the foregoing. Suitable varieties of plastics include ABS (acrylonitrile-butadienestyrene), polystyrene, high impact polystyrene (HIPS), and KYDEX™. The rigid elements (30) are visible on the exterior of the garment and include at least two cavities defined by arcuate walls for receipt of the cylindrically shaped outer surfaces of the actuator housings (50).

Figure 4:
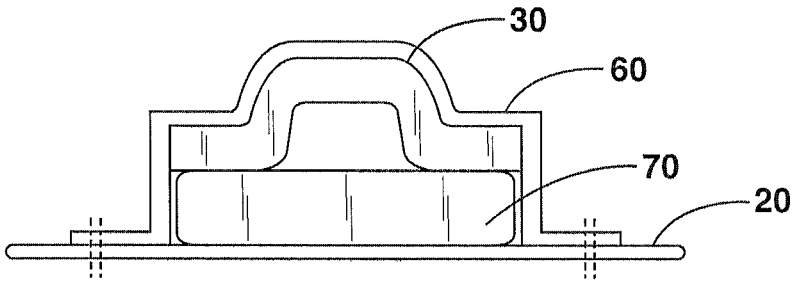
FIG. 4 is a cross sectional view of the construction of the garment and the rigid element.
Figure 5:
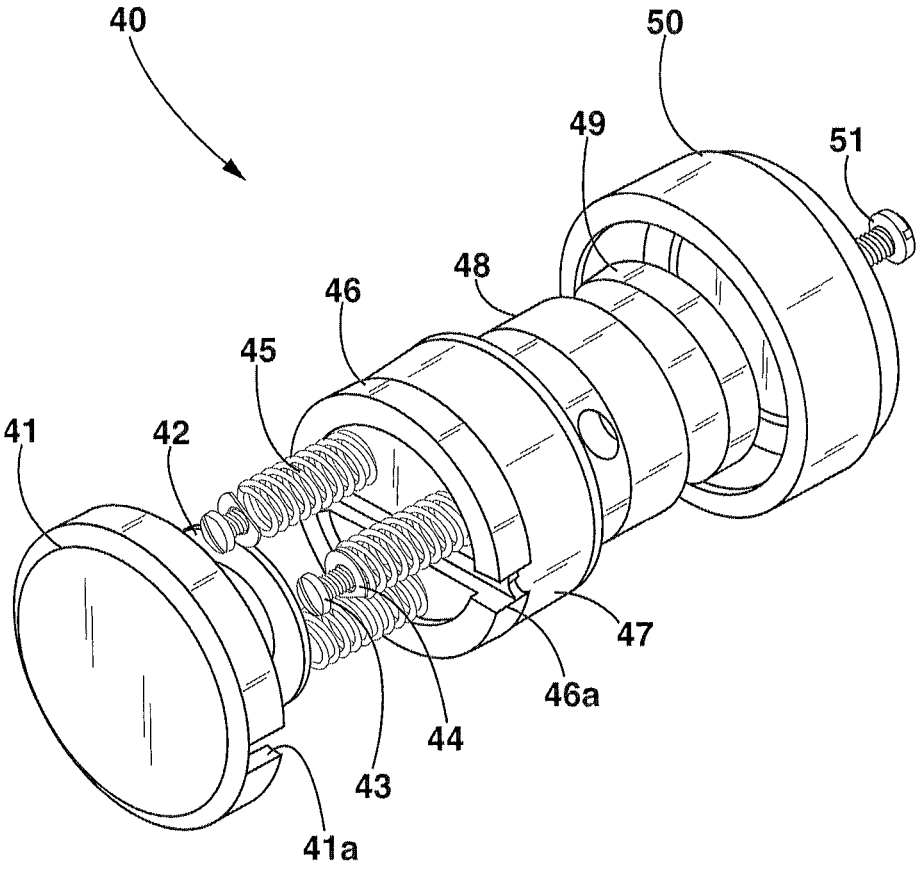
FIG. 5 is a perspective exploded view of the electromechanical actuator.
Figure 6:
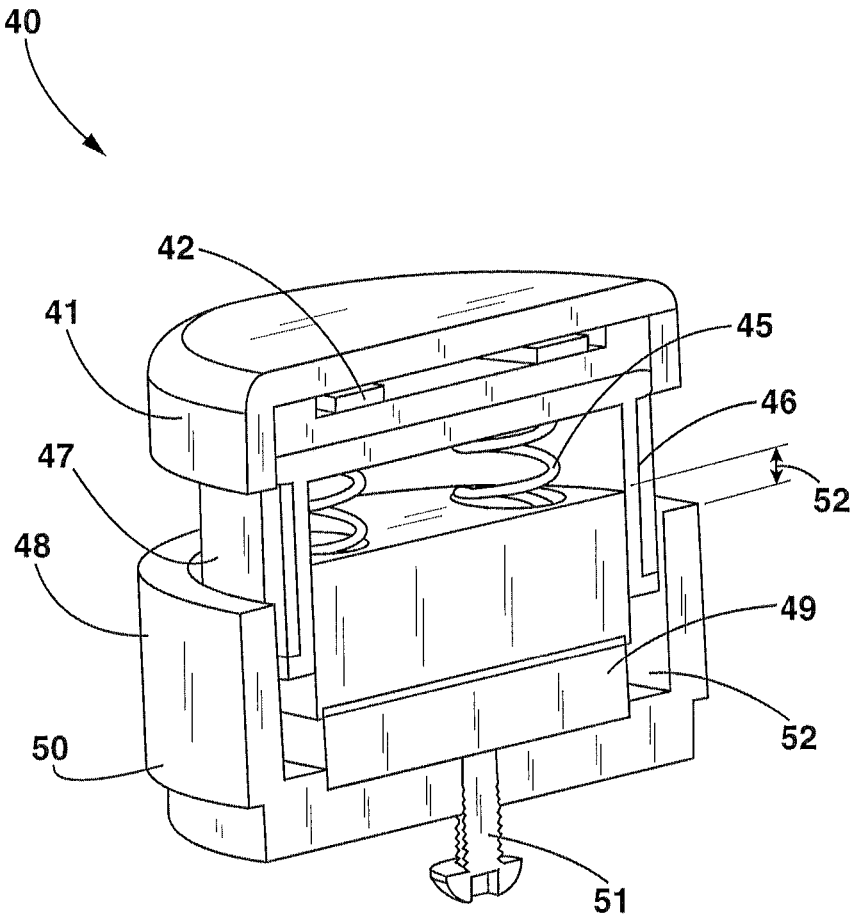
FIG. 6 is a perspective sectional view of the electromechanical actuator.

In one embodiment, as shown in FIG. 4, a textile (60) covers the rigid elements (30) and affixes them to the garment (20). A foam spacer (70) is disposed between the rigid element (30) and the garment (20) to prevent the edges of the rigid element (30) from creating high pressure points on the thorax. Preferably but not essentially, the textile (60) provides an aesthetically and tactilely pleasing interface for the rigid element (30) and protects the actuators (40) and controller (60). The textile (60) may also have design features to selectively expose parts of the rigid element (30) or the controller (60) for access by the patient. The textile (60) may be manufactured from a soft compression-formed foam overlay that can be stitched to the garment (20). One such possible material is EVA (ethylene-vinyl acetate) foam rubber with a nylon overlay to provide a water resistant wipeable surface. Other suitable materials include thermoform or compression moldable foam and textile combinations.

In one embodiment, each front rigid element (30*a*, 30*b*) retains two actuators (40*a* to 40*c*) to percuss the front region of the thorax to the right and left of the sternum. The rear rigid element (30*c*) retains four actuators (40*e* to 40*h*) to percuss the user's back, symmetrically about the spine. The number of actuators (40) and their positioning can be strategically selected. In general, the position of the actuators (40) relative to the sternum and the spine should preferably not change significantly with patients ranging from the 5th percentile to the 95th percentile, and as such a single size of rigid element (30) with adjustable placement of actuators can be used by a large portion of the patient demographic.

In one embodiment, the actuator comprises a cap (41) at one end to provide an interface to percuss the thorax, and a housing (50) at the other end to attach to the rigid element (30) with a suitable attachment means, such as a screw (51). A permanent magnet (49) creates a magnetic field that permeates through the surrounding housing (50) and inner disc (48), which are made of non-permanent magnetic materials and separated by a magnetic gap (52). A wire coil (47) wrapped around a bobbin (46) creates an electromagnet. When an electric current is passed through the wire coil (47), it produces a magnetic field opposite in direction to the magnetic field created by the permanent magnet (49). The interaction of the magnetic fields forces the bobbin (46) and the attached cap (41) against the thorax, thereby causing the chest wall to oscillate. The actuator (41) should be constructed to withstand repetitive use and heat. The bobbin (46) and cap (41) have channels (46*a*, 41*a*) through which the wire coil (47) can exit the actuator (40) without a stress point. The bobbin (46) may be constructed of a wear and temperature resistant material such as PPS (polyphenylene sulphide), ULTEM™ polymer, or polysulfone thermoplastic polymers. The bobbin may also acts as the bearing surface in the event that there are side loading forces. The wire coil (47) may be constructed with multi-strand wires or wires covered by a silicone sheath. Wire gauges ranging between 22 g and 30 g are appropriate for this application. In one embodiment, the wire coil (47) comprises 6 layers of 28 g wiring.

In one embodiment, the actuator (40) is compressible between the thorax and the rigid element (30). Thus, the rigid element (30) can "preload" the actuator (40) by pressing it against the thorax to better maintain positive contact between the cap (41) and the thorax. The actuator (40) is made compressible by springs (45) or other resilient compressible means. The springs (45) pass through apertures in the bobbin (46) and inner disc (48), connected at one end to the cap (41) using a washer (42) and bear at the other end on the magnet (49). An assembly of screws (43) and D-washers (44) retains the springs (45) to the inner disc (48). As shown in FIG. 3, a flat portion between the front right rigid element (30*a*) and the front left rigid element (30*b*) provides a positive stop to maintain consistent preloading of the actuators (40) from use to use.

Figure 7:
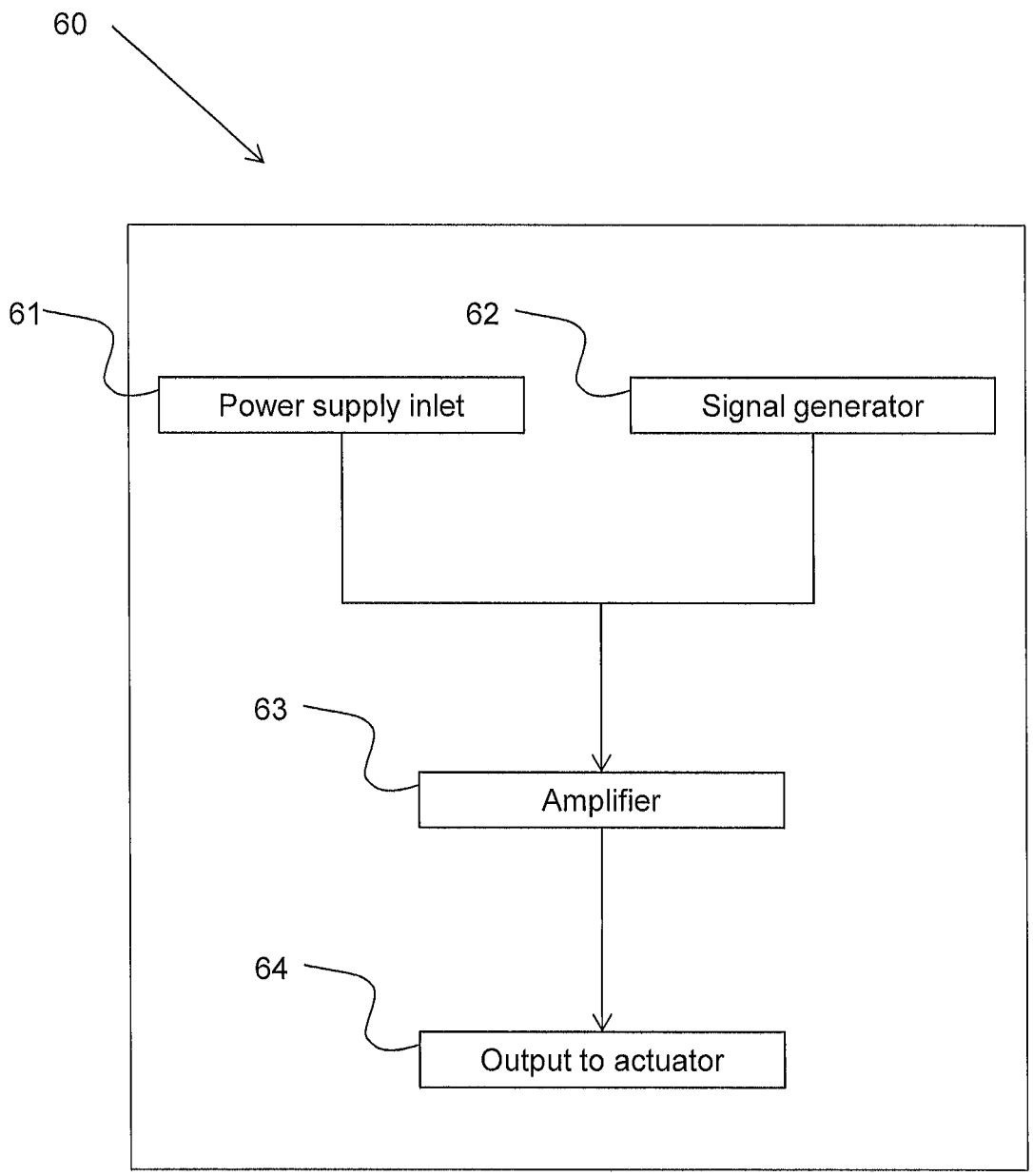
FIG. 7 is a schematic block diagram of the electronic controller.

One embodiment of the electronic controller (60), as shown in FIG. 7, comprises an operably connected power supply inlet (61), a signal generator (62), an amplifier (63) and an output to actuator (64). The power supply inlet (61) is adapted to receive electrical power from any suitable source, such as a battery, AC-DC power, or a combination of the foregoing. The signal generator (62) may generate sinusoidal, triangular and square electrical wave signals, with frequencies on the order of 10 to 25 Hz. In order to protect against current inrush from overwhelming the power supply and associated traces, the controller (60) may introduce a short delay, preferably in the order of about 0.01 to 0.5 millisecond, between the turn-on time of each actuator (40) or phase the actuators (40) with respect to each other. The amplifier (63) utilizes the signal from the signal generator (62) and power received by the power supply inlet (61) to supply a nominal current of 0.7 A RMS to the actuator (40). The amplifier (63) may include circuitry to maintain a constant percussion force despite variations in the power supply, such as an H-bridge with each channel having a dedicated chip to compensate each channel, or to have the ability to attenuate or disable a particular channel, relative to the other channels.

In one embodiment, the controller (60) may include a variety of controls such as an on/off control to start or stop a prescribed treatment cycle, a pause control to temporarily stop the treatment cycle to allow for mucous clearance, a frequency control to adjust the rate at which the actuators (40) deliver percussive force, an amplitude control to adjust the amount of current applied to the actuators (40) in a given period, and a timer for the on/off functionality to ensure that the treatment cycle is completed while accounting for any pauses.

The rigid elements (30), actuators (40) and the controller (60) may be tuned to produce desired force specifications. In one embodiment, the actuators (40) have a force constant of approximately 1 to 30 lbs per Ampere and apply percussive forces to the thorax of approximately 5 lbs, and within a reasonable range of 1 to 10 lbs, which is similar to the magnitude of forces applied by a therapist administering manual CPT. The actuator (40) comprises three springs having a spring rate of 10 lbs per inch and the actuators (40) are "preloaded" to apply a force of approximately 1 lb, within a reasonable range of 0 to 5 lbs.

What is claimed:

1. A wearable thorax percussion device, the device comprising:

(a) a garment configured to fit over the thorax and having an external surface facing away from the thorax;

(b) at least one substantially rigid element attached to the external surface of the garment and arranged to project away from the external surface of the garment;

(c) at least two electromechanical actuators each being retained by the at least one substantially rigid element and each having a housing and a mechanical member exhibiting a reciprocating motion via translation of the entirety of the mechanical member relative to the respective housing when the at least two electromechanical actuators are energized with electricity for percussing the thorax by mechanically striking the thorax, either directly or indirectly, each of the mechanical members acting against a spring bias of a plurality of springs during at least part of the reciprocating motion, wherein the housings and the mechanical members each have cylindrically-shaped outer surfaces, wherein the at least two electromechanical actuators each include a coil of wire situated within a cavity of the respective housing and shaped to form a cylinder that surrounds a portion of the cylindrically-shaped outer surface of the respective mechanical member; and (d) an electronic controller for generating and modulating an electrical signal to energize the at least two electromechanical actuators, wherein the at least one substantially rigid element is configured as a shaped shell that is visible on the exterior of the garment and that includes at least two cavities defined by arcuate walls for receipt of the cylindrically-shaped outer surfaces of the respective housings therein, and wherein the at least one substantially rigid element includes a connecting portion formed integrally with the arcuate walls to hold the cavities apart in spaced relation with one another by a distance greater than outer diameters of the housings of the at least two electromechanical actuators.

2. The device of claim 1 wherein the at least two electromechanical actuators each have a first end retained by the at least one substantially rigid element, and a second end for percussing the thorax.

3. The device of claim 2 wherein the plurality of springs comprises three springs disposed between the first end and the second end of the respective actuator for providing the spring bias and permitting the first end and the second end to be resiliently compressed between the at least one substantially rigid element and the thorax.

4. The device of claim 1 wherein the at least two electromechanical actuators are enclosed between the garment and the at least one substantially rigid element.

5. The device of claim 1 wherein the at least one substantially rigid element has a bowed shape configured to avoid impinging on a breast on the thorax.

6. The device of claim 1 wherein the at least one substantially rigid element comprises at least one front substantially rigid element attached to a portion of the garment configured to cover the front of the thorax and at least one rear substantially rigid element attached to a portion of the garment configured to cover the rear of the thorax.

7. The device of claim 1 wherein the at least one substantially rigid element is attached to the garment in a manner to adjust a position of the at least one substantially rigid element to accommodate thoraxes of different dimensions.

8. The device of claim 1 wherein the at least two electromechanical actuators each percusses with a force in the range of about 1 lbs to 10 lbs.

9. The device of claim 1 wherein the least two electromechanical actuators each percusses with a frequency in the range of about 10 Hz to 25 Hz.

10. A wearable thorax percussion device, the device comprising:

(a) a garment configured to fit over the thorax and having an external surface facing away from the thorax;

(b) at least one substantially rigid element attached to the external surface of the garment and arranged to project away from the external surface of the garment;

(c) at least one electromechanical actuator retained by the at least one substantially rigid element and having a housing and a mechanical member exhibiting a reciprocating motion relative to the housing via translation of the entirety of the mechanical member relative to the housing when the at least one electromechanical actuator is energized with electricity for percussing the thorax by mechanically striking the thorax through the garment by mechanically striking the external surface of the garment, wherein the housing and the mechanical member have cylindrically-shaped outer surfaces, wherein the at least one electromechanical actuator includes a coil of wire situated within a cavity of the housing and shaped to form a cylinder that surrounds a portion of the cylindrically-shaped outer surface of the mechanical member; and (d) an electronic controller for generating and modulating an electrical signal to energize the at least one actuator, wherein the at least one substantially rigid element is configured as a shaped shell that is visible on the exterior of the garment and that includes at least two cavities defined by arcuate walls, a first cavity of the at least two cavities receiving therein the cylindrically-shaped outer surface of the housing of a first electromechanical actuator of the at least one electromechanical actuator, a second cavity of the at least two cavities receiving therein the cylindrically-shaped outer surface of the housing of a second electromechanical actuator of the at least one electromechanical actuator, and wherein the at least one substantially rigid element includes a connecting portion formed integrally with the arcuate walls to hold the cavities apart in spaced relation with one another by a distance greater than outer diameters of the housings of the first and second electromechanical actuators.

* * * * *